United States Patent [19]

Scharpey

[11] Patent Number: 4,548,692

[45] Date of Patent: Oct. 22, 1985

[54] REDUCTION POT

[75] Inventor: Wilhelm Scharpey, Essen, Fed. Rep. of Germany

[73] Assignee: Swiss Aluminum Ltd., Chippis, Switzerland

[21] Appl. No.: 638,275

[22] Filed: Aug. 6, 1984

[30] Foreign Application Priority Data

Aug. 25, 1983 [CH] Switzerland ..... 4633/83

[51] Int. Cl.[4] ..... C25C 3/08; C25B 11/12

[52] U.S. Cl. ..... 204/243 R; 204/294

[58] Field of Search ..... 204/243 R, 244–247, 204/67, 294

[56] References Cited

U.S. PATENT DOCUMENTS

| | | | |
|---|---|---|---|
| 3,457,158 | 7/1969 | Bullough | 204/243 R |
| 3,723,286 | 3/1973 | Hunt et al. | 204/243 R |
| 4,033,836 | 7/1977 | Holmes | 204/243 R |
| 4,175,022 | 11/1979 | Vadla et al. | 204/243 R |
| 4,411,758 | 10/1983 | Hess et al. | 204/243 R |
| 4,430,187 | 2/1984 | Snaelund et al. | 204/243 R |

*Primary Examiner*—Donald R. Valentine

*Attorney, Agent, or Firm*—Bachman & LaPointe

[57] ABSTRACT

A reduction pot for the fused salt electrolytic production of aluminum comprises an outer steel shell, a thermally insulating layer, and an inner lining made essentially of carbon with iron cathode bars embedded in it. At least the lower 75% of the floor insulation is a mechanically compacted layer of a granulate material essentially of particle size ranging up to 8 mm. This granulate contains the fully ground but otherwise untreated insulation layers, without carbon residues which are sorted out mechanically before grinding, from replaced electrolytic cells. The remaining 25% of the floor insulation is a layer of firebrick, ground firebrick and/or smelter alumina. The sidewalls of the steel shell are insulated solely by firebrick.

6 Claims, No Drawings

REDUCTION POT

BACKGROUND OF THE INVENTION

The invention relates to an electrolytic reduction pot for the production of aluminum by fused salt electrolysis, wherein the said pot comprises an outer steel shell, a thermally insulating layer and a lining mainly of carbon with iron cathode bars embedded in it.

For the production of aluminum by fused salt electrolytic reduction of aluminum oxide the latter is dissolved in a fluoride melt made up for the greater part of cryolite. The cathodically precipitated aluminum collects under the fluoride melt on the carbon floor of the cell where the surface of the molten aluminum forms the actual cathode. Dipping into the melt from above are anodes which in conventional processes are made of amorphous carbon. At the anodes, as a result of the electrolytic decomposition of the aluminum oxide, oxygen is produced which reacts with the carbon of the anodes to form $CO_2$ and CO. The electrolytic process takes place in a temperature range of approximately 940°-970° C.

The electrical energy consumed in the electrolytic process can be classified in two main categories:

production or reduction energy energy losses.

The productive part of the energy that is consumed is required in order to reduce the $Al^{3+}$ cations to metallic aluminum. This productive part of the energy consumed can therefore not be lessened.

The energy losses on the other hand can be divided into various components all of which have the effect of dissipating heat losses to the surroundings. The heat produced in the electrolytic process always flows to the colder part of the pot; from there it escapes to the surroundings thus removing energy from the production process. These heat losses can be checked and must be brought to a minimum.

By using optimally suited materials for the electrical conductors the voltage drop and with that the energy losses in the electrical circuit can be reduced to a minimum.

For a long time now it has been customary to provide a thermally insulating layer in the outer steel shell in order to prevent the loss of heat through the pot or to reduce this to a low level. Usually brick made of diatomaceous earth or moler stone is employed. New moler stone materials have excellent insulating properties; they are however very sensitive to components of the electrolyte bath which penetrate the carbon lining. For this reason the insulating layer lying closest to the electrolyte bath is often made out of less temperature sensitive but poorer insulating firebrick. Since such bricks can be readily stacked on top of each other, it is possible to insulate the sidewalls and the floor of the pot without any difficulty.

It is proposed in U.S. Pat. No. 4,052,288 to grind the linings of spent reduction cells i.e. residual carbon and insulation, and then to treat this with a strong alkaline solution so that the fluorides of sodium and aluminum are removed. A binder, usually petroleum pitch, is then added to produce a paste for lining new reduction cells.

U.S. Pat. No. 4,430,187 describes a reduction pot in which at least the lower 80% of the cell floor insulation is made up of a compressed vulcanic ash layer, the rest of the insulation on the cell floor of a leakage barrier which screens the vulcanic ash from the bath components penetrating the carbon lining.

The object of the present invention is to develop an electrolytic reduction pot for the production of aluminum by the fused salt electrolytic process, in which the manufacturing costs for the thermal insulation can be significantly lowered without the quality of the pot suffering in terms of thermal insulation and useful service life.

This object is achieved by way of the invention in that at least the lower 75% of the floor insulation of the cell is a compacted layer of a granulate material from replaced electrolytic cells essentially of particle size ranging from 0.01 to 8 mm and containing the fully ground but otherwise untreated insulation layers, without carbon residues which are mechanically sorted out before grinding. The remaining 0-25% is a layer of firebrick, ground firebrick and/or smelter alumina, and the sidewalls of the steel shell are insulated solely by firebrick.

DETAILED DESCRIPTION

The particle size of the ground granulate is preferably between 0.1 and 4 mm.

If a pot has to be replaced, the lining is broken up, removed, and in most cases thrown away. By using alumina as insulating material it is possible to recycle the aluminum oxide from the floor insulation, provided the necessary equipment for this is available at the smelter.

The use of moler stone materials and alumina as insulating materials represents a significant cost factor for an aluminum smelter as both materials are expensive. In conventinal electrolytic cells the floor insulation is generally made up of three layers of moler stone bricks and a layer of firebrick which is more resistant to the electrolyte but also more expensive.

In the manufacture of the insulation according to the invention these four brick layers are removed from the cell which is to be replaced, and then ground. Any pieces of carbon which are present are first sorted out mechanically, likewise the larger pieces of solidified aluminum. The ground granulate comprises mainly moler stone, to a lesser extent firebrick, and can also contain small amounts of aluminum.

The thickness of the compacted granulate layer is preferably 250-300 mm, on top of which is usefully deposited a layer of firebrick, ground firebrick and/or aluminum oxide, which is, however, preferably not thicker than 100 mm.

To provide the compacted granulate layer with better protection from electrolyte components penetrating the carbon lining, an additional, impermeable and flexible graphite membrane, which is held together by a steel support foil, can be placed on the granulate layer (of TMS Paper LM 78/19 and U.S. Pat. No. 4,175,022.

The granulate material is poured dry into the cell and then mechanically compacted for example by ramming and/or vibrating. Wet granulate material is preferably dried beforehand.

The electrolytic cell with the insulation layer according to the invention exhibits the following advantages:

A cost savings of about 70% compared with conventional reduction cells with floor insulation of moler stone and firebrick.

The brickwork from the cell that is to be replaced can be fully used.

A considerable number of man hours is saved during the installation.

The ground granulate materials are saturated with fluorides so that they take up less fluoride when in service.

No new bricks have to be cut.

The old bricks do not need to be washed clean.

The transport to the refuse dump and the ever increasing costs for dumping are eliminated. Dumps for brick waste must be provided with a bedding of calcium compounds.

No materials store need be provided on the smelter site.

The possibility of electrolyte and metal leaking through the layer of insulation is smaller as there are no joints, the firebrick and moler stone material is mixed and the corners and irregularities are filled better.

Temperature measurements made on cells over an extended period of operation have shown that pot floors with the layer of insulation according to the invention do not exhibit higher temperatures than pot floors with conventional brick insulation layer. The thermal insulation can therefore be regarded as at least as good as that of the conventional insulation.

What is claimed is:

1. Reduction pot for producing aluminum by the fused salt electrolytic process, comprising an outer steel shell having a floor and sidewalls, a thermally insulating layer covering said shell, and an inner lining covering said layer made essentially of carbon with iron cathode bars embedded in it, wherein at least the lower 75% of the floor insulating layer is a mechanically compacted layer of a granulate material from replaced electrolytic cells comprised mainly of moler stone essentially of particle size ranging from 0.01 to 8 mm and containing the fully ground but otherwise untreated insulation layers substantially free from carbon residues, and wherein the remaining 0–25% is a layer selected from the group consisting of firebrick, ground firebrick, smelter alumina and mixtures thereof, and the sidewalls of the steel shell are insulated solely by firebrick.

2. Reduction pot according to claim 1 wherein the ground granulate is mainly of moler stone, a smaller fraction of firebrick material and inclusions of aluminum.

3. Reduction pot according to claim 1 wherein the thickness of the compacted granulate layer is 250–300 mm.

4. Reduction pot according to claim 1 wherein an impermeable, flexible graphite membrane held together by a steel support foil is provided on the compacted granulate layer.

5. Reduction pot according to claim 1 wherein the particle size varies from 0.1 to 4 mm.

6. Reduction pot according to claim 1 wherein the remaining layer is not thicker than 100 mm.

* * * * *